United States Patent [19]

Fane

[11] Patent Number: 4,633,687

[45] Date of Patent: Jan. 6, 1987

[54] DRIVE MECHANISM FOR KEY OPERATED ELECTRONIC LOCK

[75] Inventor: William J. Fane, North Vancouver, Canada

[73] Assignee: NI Industries, Inc., Long Beach, Calif.

[21] Appl. No.: 693,185

[22] Filed: Jan. 22, 1985

[51] Int. Cl.[4] ..... E05B 47/00

[52] U.S. Cl. ..... 70/276; 70/278; 70/413

[58] Field of Search ..... 70/276, 277, 278, 364 A, 70/375, 413; 292/359; 361/171; 340/825.31; 307/10 AT; 235/302.5

[56] References Cited

U.S. PATENT DOCUMENTS

| | | | |
|---|---|---|---|
| Re. 26,677 | 10/1969 | Russel | 70/107 |
| 2,929,651 | 3/1960 | Friedman | 292/359 |
| 3,967,846 | 7/1976 | Schlage | 292/359 |
| 4,385,510 | 5/1983 | Harper | 70/375 |
| 4,399,673 | 8/1983 | Gotanda | 70/278 |
| 4,414,831 | 11/1983 | Perkut | 70/278 |
| 4,507,944 | 4/1985 | Widen | 70/278 |

*Primary Examiner*—Robert L. Wolfe

*Attorney, Agent, or Firm*—Beehler, Pavitt, Siegemund, Jagger, Martella & Dawes

[57] ABSTRACT

For an electronically motivated door lock there is a key carrying magnetic coding for actuating an electronically triggered release mechanism to unlock a door. Insertion of the key in the keyway initially closes a switch to energize the electronic circuit. The electronic circuit is programmed to motivate a motor driven mechanism in successive stages to move a blocking finger into and out of engagement with a notch in a rotatable disc on a cylinder plug which operates the latch bolt. The motor rotates preferably in one direction but by use of a rotating drive pin shiftable from end to end of a transverse slot, the blocking finger is moved alternately into and out of engagement with the notch in response to the successive energizations of the motor.

16 Claims, 14 Drawing Figures

Fig. 1.
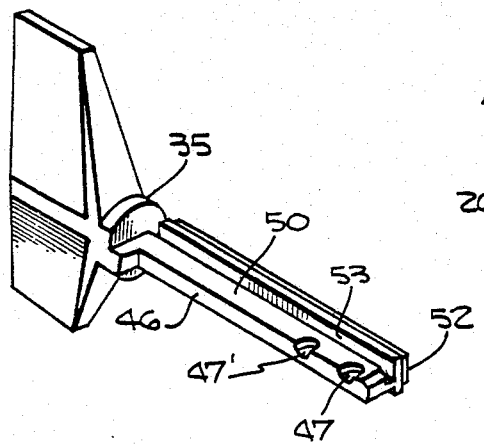
Fig. 2.
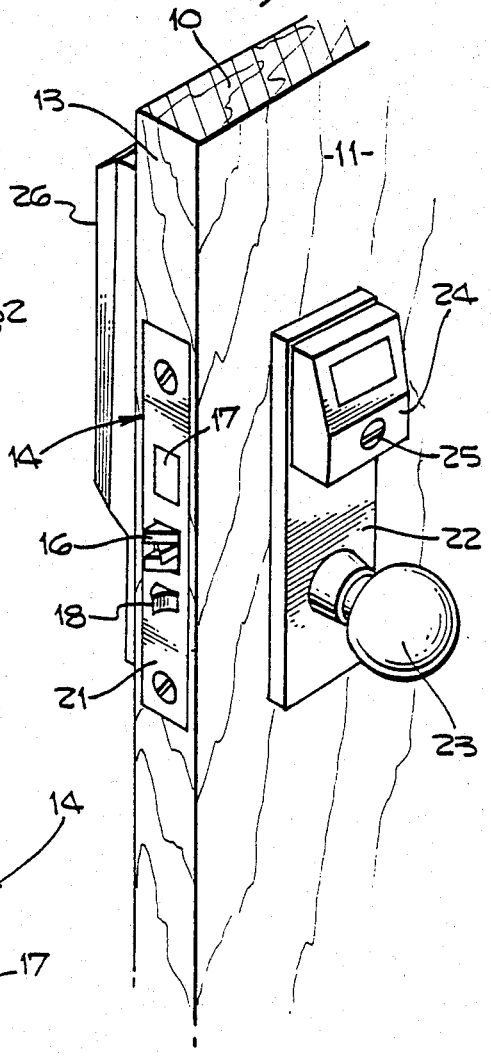
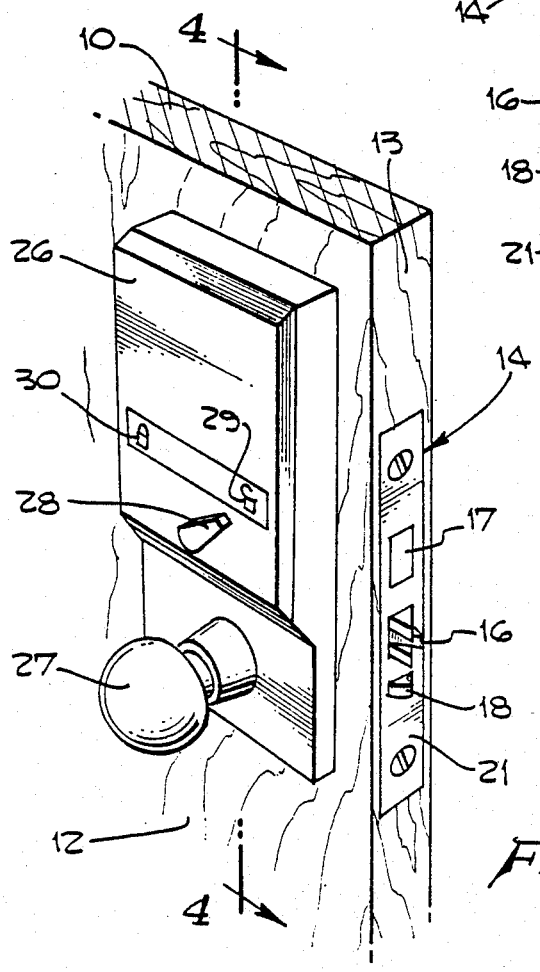
Fig. 3.

Fig. 11.
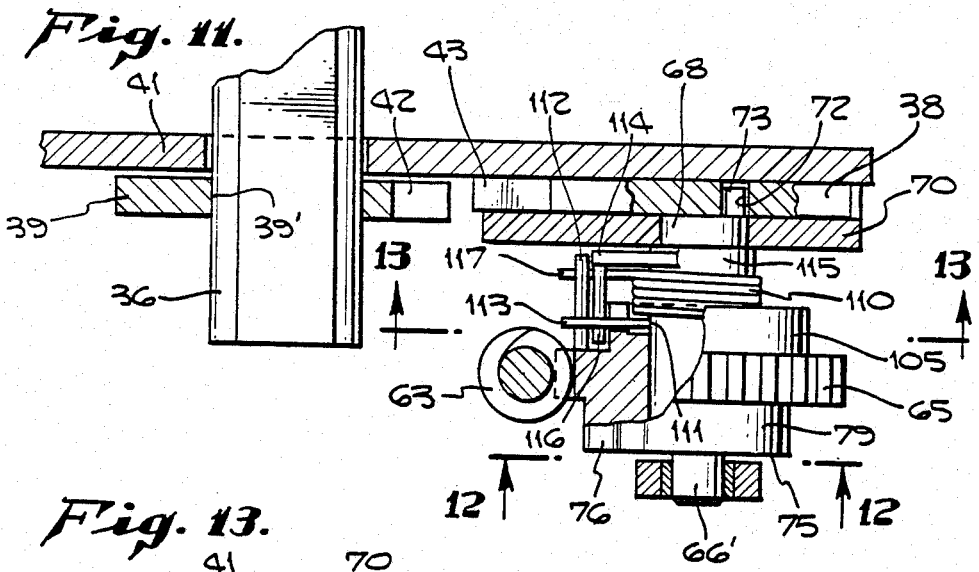
Fig. 13.
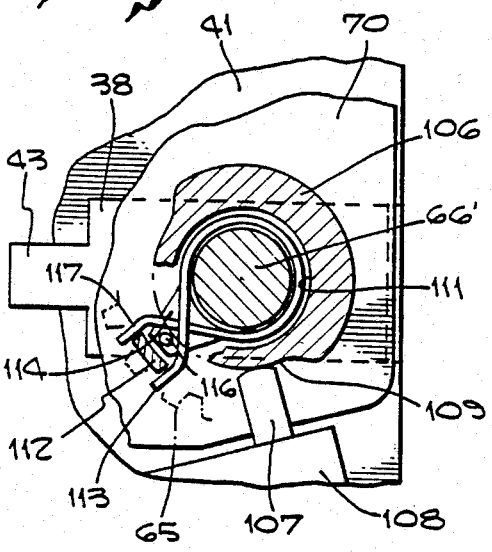
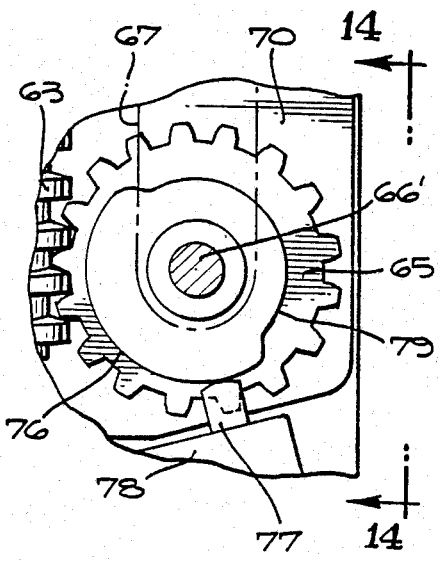
Fig. 12.
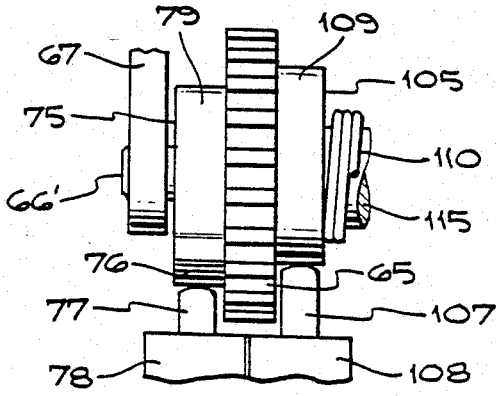
Fig. 14.

DRIVE MECHANISM FOR KEY OPERATED ELECTRONIC LOCK

The invention here involved concerns primarily the mechanical expedient relied upon for the locking and unlocking operation of a latch bolt by manipulation of a key which, after motivating the electronic circuit, is itself relied upon to withdraw the latch bolt from locked position. The key is resorted to instead of a magnetic card such as is customarily relied upon for motivating an electronic circuit. Because of the inherent versatility residing in current-day electronic circuits for performing work of virtually any kind, the tendency has been to employ mechanical expedients relatively freely because the electrical means is readily available to control and manipulate their operation. Although the generous use of such expedients makes it possible to develop such mechanisms relatively quickly, cost ultimately becomes a factor both from the point of view of number of parts involved as well as efficiency of operation of the mechanism, especially where it depends upon a battery source for energy.

It is therefore among the objects of the invention to provide a new and improved drive mechanism for a key operated electronic lock wherein the number of individual parts involved has been reduced appreciably to a relative minimum, while at the same time being capable of effectively providing all of the needed functional characteristics.

Another object of the invention is to provide a new and improved drive mechanism for a key operated electronic lock which is more efficient in its operation and accordingly exerts less call for electrical energy customarily provided by a battery pack, the result of which is either a battery pack of smaller size, longer life, or a combination of both.

Still another object of the invention is to provide a new and improved drive mechanism for a key operated electronic lock of such construction that should there be a hang-up of critical moving parts, the mechanism nevertheless proceeds to a shut-off position, avoiding undue drain on the battery pack.

Still another object of the invention is to provide a new and improved drive mechanism for a key operated electronic lock wherein the locking expedient is of such character that the lock cannot be disturbed from its locked condition by unauthorized means.

Still further among the objects of the invention is to provide a new and improved drive mechanism for a key operated electronic lock of substantially reduced size, both with respect to mechanical expedients and battery pack, thereby to materially reduce not only the initial cost, but also installation costs and servicing.

Also included among the objects of the invention is to provide a new and improved drive mechanism for a key operated electronic lock of such character that it is in effect panic proof with respect to occupants of a room closed by a door so equipped, the mechanism, however, being sufficiently versatile to permit installation on either the inside or outside face of a door.

With these and other objects in view, the invention consists of the construction, arrangements, and combination of the various parts of the device serving as an example only of one or more embodiments of the invention, whereby the objects contemplated are attained, as hereinafter disclosed in the specification and drawings and pointed out in the appended claims.

In the drawings:

FIG. 1 is a side perspective view of a typical key used for the electronic lock;

FIG. 2 is a perspective view of a fragment of door showing the outside face with a corresponding portion of the electronic lock mounted thereon;

FIG. 3 is a perspective view showing the inside face of a fragment of door with a corresponding portion of the electronic lock mounted thereon;

FIG. 11 is a fragmentary sectional view similar to FIG. 6 but showing a modified form of the device;

FIG. 12 is a fragmentary elevational view on the line 12—12 of FIG. 11;

FIG. 13 is a fragmentary sectional view on the line 13—13 of FIG. 11;

FIG. 14 is a fragmentary elevational view on the line 14—14 of FIG. 12.

Figure 4:
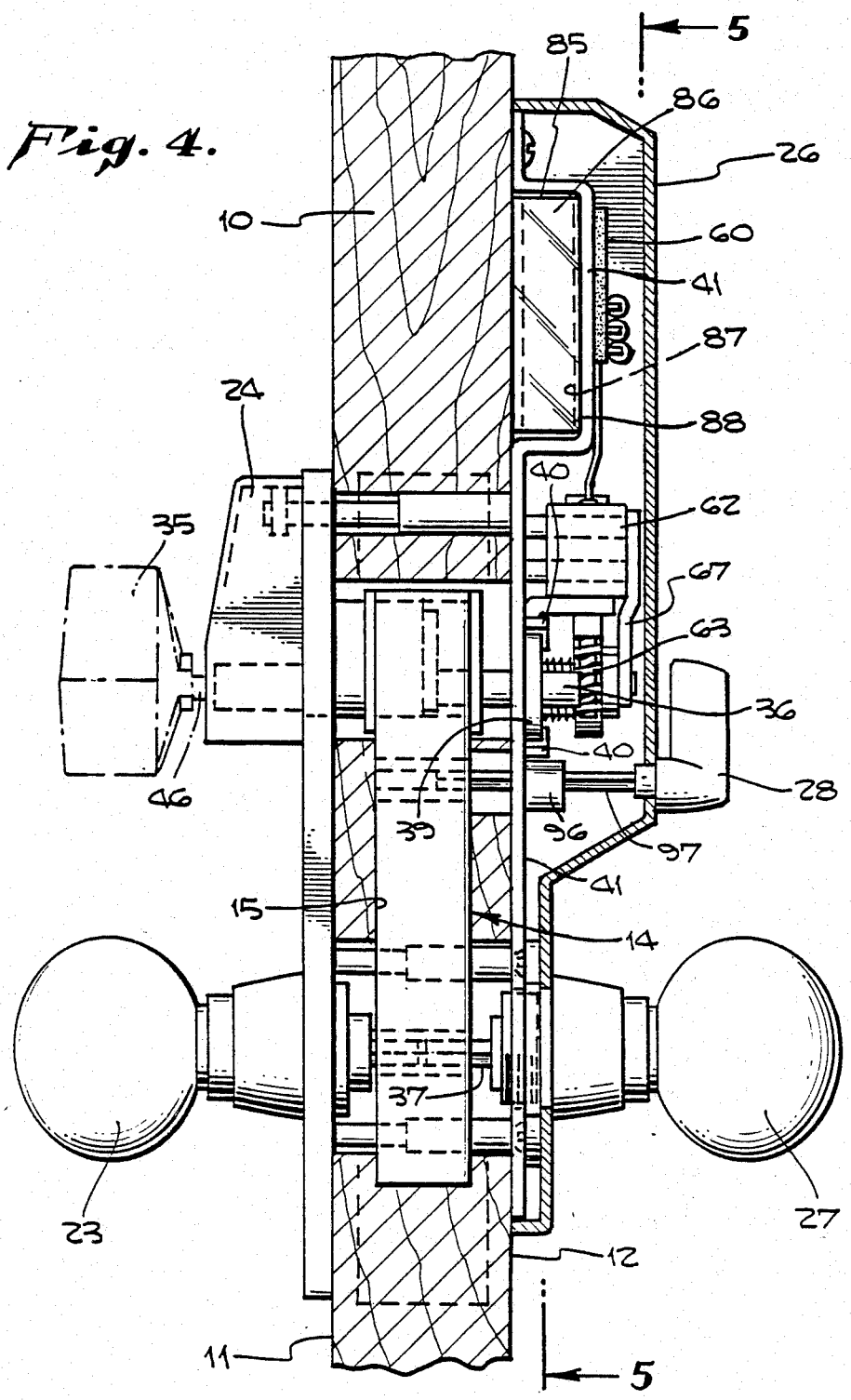
FIG. 4 is a vertical sectional view on the line 4—4 of FIG. 3.
Figure 5:
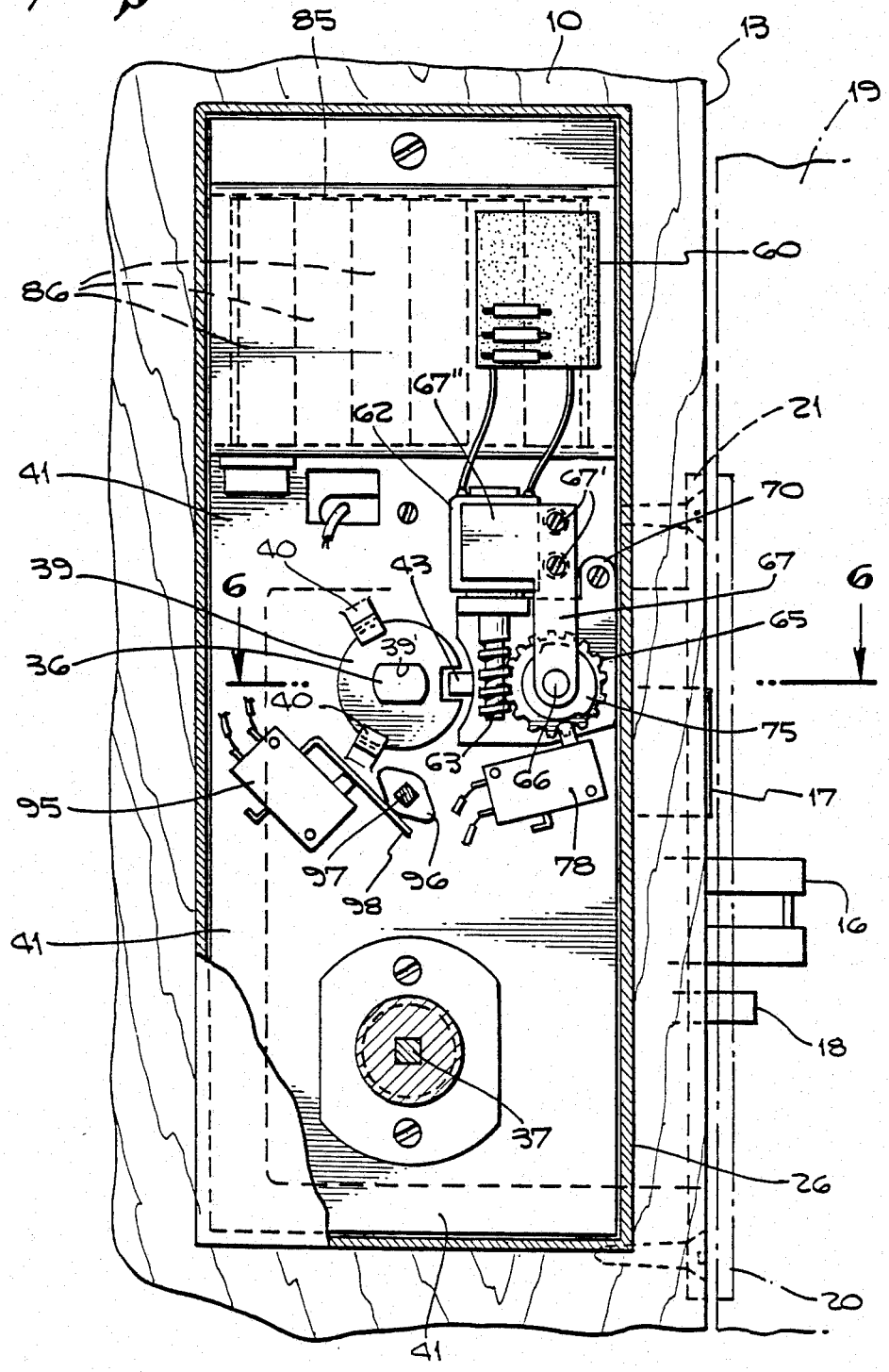
FIG. 5 is a vertical sectional view on the line 5—5 of FIG. 4.

In an embodiment of the invention chosen for the purpose of illustration and in particular as appears in FIGS. 2, 3 and 4, there is shown a section of a conventional hinged type door 10 having an outside face 11, an inside face 12, and an edge face 13. The locking mechanism shown in cooperation with the mechanism of the invention is embodied in a substantially conventional mortise type lock indicated generally by the reference character 14 which is lodged in a mortise recess 15 between opposite outside and inside faces 11 and 12 of the door, as shown in FIG. 4, and extending inwardly from the edge face 13, as shown in FIG. 5. The mortise type lock provides a latch bolt 16, a dead bolt 17, and an auxiliary bolt 18 functioning in a substantially conventional manner, as disclosed in U.S. Pat. No. Re. 26,677. Structural details have been omitted in the interest of simplicity and clarity in focusing upon the innovative features of the present invention.

Following conventional practice, the door is adapted to cooperate with a door frame 19 supporting a strike plate 20 located opposite an edge plate 21, which is part of the mortise type lock 14, the edge plate being provided with appropriate recesses through which pass the latch bolt 16, the dead bolt 17, and the auxiliary bolt 18.

Further, as shown in FIGS. 2, 3 and 4, there is an outside cover plate 22 providing a mounting for a knob 23 which may be grasped for opening the door and an auxiliary cover housing 24 in which a keyway 25 is located.

An inside cover plate 26 located on the inside face 12 of the door provides a mounting for an inside knob 27 for manipulation of the latch bolt 16. A thumbturn lever 28 manipulates the dead bolt 17. Handle levers may on occasion be substituted for the knobs 23 and 27. In FIG. 3 the thumb-turn lever is directed clockwise to an unlocked indicator 29. A locked indicator 30 is on the opposite side.

In the chosen embodiment the arrangement is one wherein when the door is closed with the latch bolt 16 extended, the auxiliary bolt 18 depressed in a conventional fashion. The door is locked from the outside and can only be unlocked from the outside by use of a key 35, see FIGS. 1 and 4, acting through an appropriate cylinder plug assembly, one element of which is an elongated cylinder plug 36. At the inside the knob 23 acting through a spindle 37 and the substantially conventional mortise type lock 14 serves to withdraw the latch bolt 16 so that the door can be unlatched and opened. The mortise lock mechanism with which the inside knob 27 is associated operates directly and bypasses any activity associated with the key 35.

Figure 8:
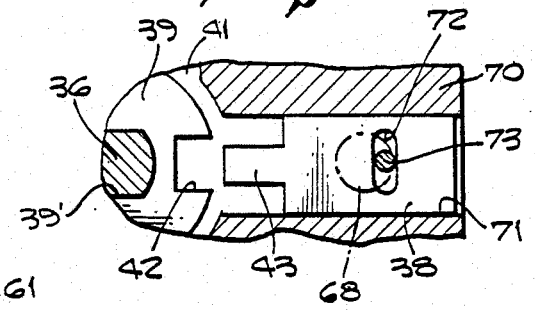
FIG. 8 is a fragmentary cross-sectional view on the line 8—8 of FIG. 6.
Figure 9:
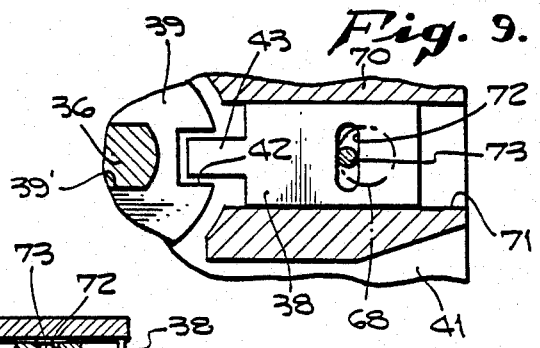
FIG. 9 is a fragmentary cross-sectional view similar to FIG. 8 but showing the locked position.

To maintain the latch bolt 16 extended with the parts in locked condition, subject to withdrawal by mainpulation of an authorized key, there is provided a locking bar 38 serving as a blocker, centerably disposed with respect to FIG. 5, and shown in additional detail in FIGS. 8 and 9. In order for the locking bar 38 to block manipulation by key 35, use is made of a washer 39 in non-rotatable engagement with the cylinder plug 36 and held in place by tabs 40 struck from an inside mounting plate 41. There is a notch 42 forming a shoulder in the washer 39 which receives a finger 43 of the locking bar 38, in that way to block rotation of the washer 39. The washer in turn has a non-circular hole 39' for reception of the cylinder plug 36. Also included in the cylinder plug assembly is an extension 44 subject to rotation by the key 35. Even though the cylinder plug assembly is interconnected by conventional linkage to the mortise type lock 14 and latch bolt 16, the electronic components must be key activated by a properly authorized key applied to the lock at the outside face of the door.

The key 35, shown in some detail in FIG. 1, has a handle 45 with an elongated shank 46 which carries key cuts 47 and 47' on an upper face 50 for cooperation with sets of pin tumblers 48, 48' in a pin tumbler block 49. A flange 51, running the length of the shank 46, carries a magnetic strip 52 which bears electronic coding. The flange 51 is spaced from the shank 46 to provide a groove 53. A complementary flange, not shown, on the extension 44 serves as a guide for the shank of the key as it is inserted into the keyway 25.

Figure 6:
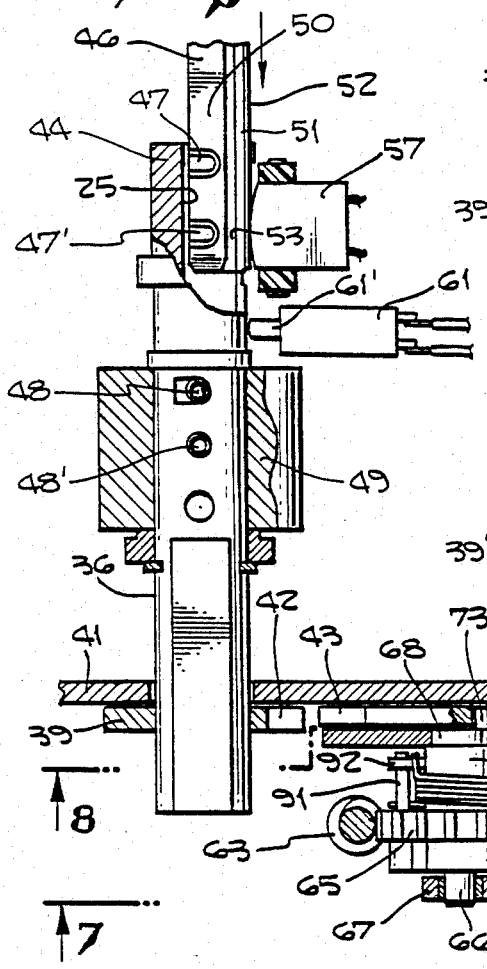
FIG. 6 is a cross-sectional view on the line 6—6 of FIG. 5.

When the lock is to be unlocked from the outside, insertion of the key into the keyway serves initially to energize an appropriate electronic circuitry embodied in part in a printed circuit indicated generally by the reference character 60, housed and shown within the inside cover plate 26. For energizing the electronic circuitry, there is a switch 61 in the outside cover housing 24 actuatable by key action against an arm 61', see FIG. 6, normally in an open position, wherein the circuit is deenergized. To shift the switch 61 from the open or deenergized position to the closed or energized position, it is necessary only to insert the shank 46 of the key 35 into the keyway 25 past a read head 57. The shank has a breadth sufficient to move the switch physically in a lateral direction relative to the key shank 46, as viewed in FIG. 6. When the switch arm 61' is shifted, the switch is closed and the circuit is energized.

As the shank 46 continues to be inserted into the keyway 25 for its full depth, the appropriate portion of the magnetic strip 52 is moved into engagement with the read head for triggering the electronic circuit.

Figure 7:
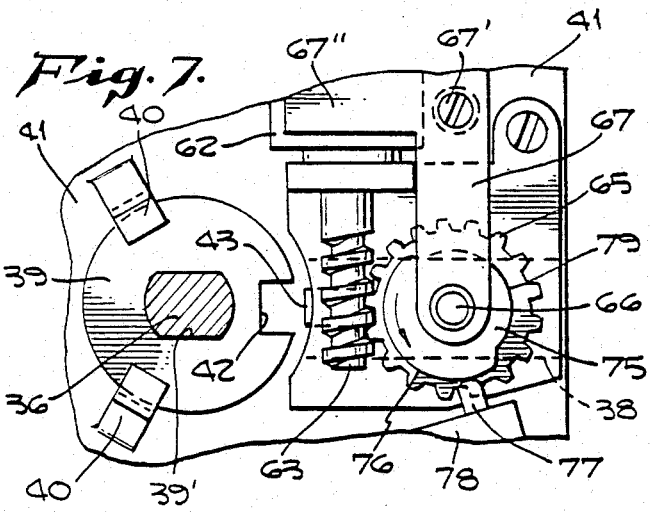
FIG. 7 is a fragmentary elevational view on the line 7—7 of FIG. 6.
Figure 10:
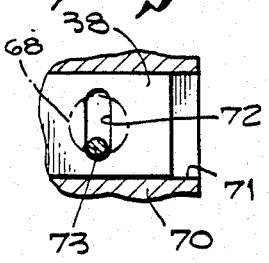
FIG. 10 is a fragmentary sectional view similar to FIGS. 8 and 9 but showing a position intermediate that of FIGS. 8 and 9.

When the coding on the magnetic strip is the authorized and correct coding for which the electronic circuitry has been programmed, a motor 62, shown in FIGS. 5 and 7, will be actuated. Actuation of the motor 62 serves to withdraw the locking bar 38 from its blocking or locking position.

The drive shaft of the electric motor 62 includes a worm 63. The worm meshes with a gear 65, semi-rotatably connected to a power transfer shaft 66, the shaft 66 being supported by its bracket 67 bolted in turn by bolts 67' to the mounting plate 41. An arm 67'' of the bracket 67 overlies the motor and assists in holding the motor in place. At its inner end a portion 68 of the power transfer shaft 66 is rotatably carried by a flange 70 on the mounting plate 41. The flange 70 serves also to provide a slideway 71 for the locking bar 38 previously made reference to.

For reciprocating the locking bar 38 and its finger 43 into and out of engagement with the notch 42, there is a transversely disposed elongated slot 72 in the locking bar 38, opposite along sides of which provide tracks for cooperation with a drive pin 73. The drive pin 73 has an eccentric mounting with respect to rotation of the inner portion 68 of the power transfer shaft 66. From the foregoing description it will be apparent that as the power transfer shaft 66 rotates from the position of FIG. 8 an angular distance of 180° to the top dead center position of FIG. 9, the drive pin 73 will propel the locking bar 38 in a direction from right to left until the finger 43 is lodged in the notch 42. When occasion arises to withdraw the finger 43 from the notch 42, rotation of the drive pin in the same or reverse direction throughout a second 180° angular distance, namely, from the top dead center position of FIG. 9 to the position of FIG. 8, the drive pin 73 will propel the locking bar 38 in a direction from left to right a distance sufficient to withdraw the finger 43 from the notch 42.

In that it is the energization of the motor 62 which is depended upon for reciprocating the locking bar between its two positions, provision need be made for deenergizing the motor after the locking bar has been moved to one or another of the two positions. For this there is provided a camming disc 75 non-rotatably mounted with respect to the gear 65. One arcuate portion 76 of the camming disc is adapted to engage a switch arm 77 of a limit switch 78, depressing the limit switch to a position where the motor circuit is provisionally deenergized, as, for example, when the finger 43 has been withdrawn from the notch 42. After the next 180° rotation of the drive pin 73, when a second arcuate portion 79 is positioned adjacent the switch arm 77, the circuit to the motor 62 is again provisionally deenergized. As a precaution, resort may be had to two limit switches like the switch 78, one being operable by the arcuate portion 76 and the other by the arcuate portion 79.

Energization of both the electronic circuit 60 and the motor 62 is provided by a battery pack 85 in the chosen embodiment. An appropriate battery pack may consist of one or more batteries 86 mounted in a pocket 87 provided by a jacket 88 on the mounting plate 41.

To guard against depleting the battery power, which could happen should there be a hang-up in reciprocating movement of the locking bar 38, there is provided a resilient interconnection between the transfer shaft 66 and the gear 65. Under circumstances where, as in the first described embodiment, the motor rotates at successive intervals in the same direction, a torsion spring 90, see FIG. 6, may be employed, one end of which is attached to a pin 91 which projects inwardly from the inside face of the gear 65. The other end of the torsion spring is attached to a pin 92 which projects radially outwardly from the transfer shaft 66. There is sufficient power in the torsion spring 90 to have the pins 91 and 92 in engagement with a set preload. Under normal conditions of operation, the torsion spring will exert sufficient force to have the shaft drawn around following the gear so that the shaft and gear rotate together. Accordingly, the locking bar is moved between the locking position of FIG. 9 and the release position of FIG. 8 by forward rotation of the gear and consequently comparable rotation of the transfer shaft.

If, for some reason, movement of the locking bar is hung up, thereby prevented from moving, whether in one direction or the other as, for example, if the key is twisted before the motor has had time to withdraw the locking bar fully, then the torsion spring comes into play. The motor 62 will turn the worm 63 to drive the gear 65 until the cam operates the limit switch 78 in the normal manner, but the transfer shaft will not be able to rotate. Instead, the preloaded projections, namely, the pins 91 and 92, will separate as the gear winds up the torsion spring 90. The motor 62 then is deenergized normally and hence is not left fighting the hung-up situation thereby to deplete the battery pack. When the hang-up or binding is relieved, the energy in the torsion spring will rotate the transfer shaft to operate the locking bar in the normal manner and at the same time draw the pins again into engagement.

When the latch bolt is in extended position, with the parts in locked condition, it can be withdrawn by key operation. To withdraw the latch bolt, the key 35 is first inserted and by tripping the switch 61 energizes the electronic circuit. Under circumstances where the circuit is properly programmed, the motor 62 operates through the gear train to withdraw the locking bar from engagement with the washer 39 and the latch bolt is thereafter physically withdrawn by rotation of the key 35. When the key is withdrawn from the keyway, as it would be normally, the circuit to the motor 62 is again energized and the motor operating again in the chosen rotational direction causes the gear 65 to rotate to return the locking bar to its locked condition with respect to the washer 39. At the end of that operation, the cam acts on the appropriate limit switch 78 to deenergize the motor 62.

Under other circumstances where the motor is programmed to operate in the opposite direction after each energization, the torsion spring action needs modification in keeping with good practice as exemplified by the mechanism of reverse acting door knobs. Reverse action is accommodated by a modified form of the device as shown in FIGS. 11, 12, 13 and 14.

In the interest of security, it is of consequence to note that when the mechaism is in locked condition, as depicted in FIG. 9, the drive pin 73 is in a position which may aptly be described as top dead center. In that top dead center position the slider is locked against end thrust, in an outward or unlocking direction, the condition being one which makes it impossible to open the lock by rapping or jarring it in the hope of making the locking bar bounce out of position.

As a further security expedient, the electronic programming can be one designed so that the dead bolt can be extended and withdrawn from locked position only by the occupant of the room with the aid of the thumbturn lever 28.

To prevent withdrawal of the dead bolt 17 by key operation, there is provided a switch component 95, see FIG. 5. For activating the switch component, an actuator button 96 is provided on a rod 97 on which the thumbturn 28 is mounted. When the thumbturn is rotated a distance sufficient to fully extend the dead bolt 17, the actuator button 96 shifts the position of the arm 98 of the switch component 95, in that way to so condition the electronic circuit that the key 35, even when correctly coded, cannot activate the motor 62 in order to withdraw the locking bar 38.

To make this sequence operative, it can be assumed that the electric circuit to the motor includes a portion through a closed switch component 95. Accordingly, when depression of the arm 98 by the actuator button breaks the circuit, the motor 62 cannot be activated to withdraw the locking bar 38. Under such circumstance the cylinder plug 36 cannot be rotated by the key to withdraw the latch bolt 16.

When the thumbturn has subsequently been rotated in reverse direction to itself withdraw the dead bolt 17, the arm 98 is released and through the switch component 95, the circuit is returned to initial operating condition. The electronic circuitry can, however, be so programmed that the dead bolt, although extended, can in fact be withdrawn by a special key arrangement.

In the embodiment of the invention of FIGS. 11, 12, 13 and 14, embodying certain precautionary features, provision is also made for accommodation of a motor drive capable of reverse operation for each successive actuation of the locking bar 38.

In addition to the camming disc 75 at the outer side of the gear 65, there is a second camming disc 105 on the opposite face of the gear 65. As in the case of the camming disc 75, the added camming disc 105 is provided with one arcuate portion 106 extending for substantially 180° around the camming disc, and another arcuate portion 109 extending for the remainder of the circumference of the camming disc. There is a second limit switch 108 from which extends a switch arm 107 in a position adapted to engage one or another of the arcuate portions 106 and 109.

In this form of the device, initially identified limit switch 78 is programmed to operate, as heretofore described, for rotation of a power transfer shaft 66' in an initial direction. After the power transfer shaft 66' has been brought to rest by action of the limit switch 78 and is subsequently called upon to rotate again, the rotation will then be in the opposite direction, as a result of the electronic programming. The position of the switch arm 107 with respect to the arcuate portion 106 of the camming disc enables the motor 62 to continue operation of the power transfer shaft 66' throughout a distance of 180° sufficient to shift the locking bar 38 throughout its full distance in one direction or the other. At the end of the 180° rotation, the other arcuate portion 109 of the camming disc 105 will so position the switch arm 107 of the limit switch 108 that power will then be shut off from the motor 62 and the operation will be stopped.

It should be understood that whether successive rotations of the power transfer shaft 66' or 66, as the case may be, should be continuously in one direction or alternating in reverse directions, drive pin 73 will alternately shift the locking bar 38 and its finger 43 between a position of engagement with the notch 42 and a position out of engagement with the notch 42 and its blocking effect upon the cylinder plug 36.

To accommodate the alternating reverse operation of the power transfer shaft 66' as described, there need be an appropriate modification in operation of an appropriate torsion spring 110. To accommodate multiple turns of the torsion spring 110, a recess 111 is provided in the camming disc 105. Extending from the gear 65 is a transverse extension 112, previously identified as a lug, in position to engage one end 113 of the torsion spring 110 in one direction. An arm 114 extending radially outwardly from an enlarged portion 115 of the power transfer shaft 66' has a transverse extension 116 positioned to engage the other end 117 of the torsion spring in the opposite direction.

In the form of invention of FIGS. 11 and 13, for example, there is sufficient power in the torsion spring 110 to have the extensions 112 and 116 in engagement with a set pre-load. In this form of the invention the torsion spring will exert sufficient force to have the power transfer shaft 66' drawn around following the gear 65, in either direction of rotation of the shaft. It should be understood that in this form of the invention, as in the first form of the invention, the power transfer shaft 66' is capable of rotating relative to the position of the gear 65.

Considering, for example, counterclockwise rotation of the gear 65, as viewed in FIG. 13, if the shaft 66' is prevented from rotating, the extensions 112 and 116 will separate. Accordingly, the extension 112 will draw the spring end 113 away from the extension 116, winding up the torsion spring 110. When the bound condition is relieved, then the end 117 of the torsion spring will drive the extension 116 until it once again aligns with the extension 112, drawing the power transfer shaft 66' along with it.

For clockwise rotation of the gear, the action is comparable except that the extension 112 will draw the spring end 117 away from the extension 116, winding up the spring. Subsequently, when the bound condition is relieved, the other end 113 of the torsion spring will draw the extension 116 to a position where it again aligns with the extension 112 and as a consequence drawing the power transfer shaft 66' along with it.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A locking mechanism including an electronically programmed actuating mechanism for enabling manipulation of said locking mechanism, said locking mechanism comprising a frame having therein a locking bolt movable between an extended locked position and a retracted unlocked position, a cylinder plug assembly for said locking bolt rotatably mounted on said frame, said cylinder plug assembly being responsive to manual rotation, said cylinder plug assembly having a rotation inhibiting shoulder, a blocker having a first position in engagement with said shoulder inhibiting movement of said locking bolt and a second position removed from said first position, an electric motor powered means having an operable linkage with said blocker for moving said blocker between said first and second positions, said linkage comprising a power transfer means mounted for rotation on said frame, a drive member eccentrically located on said power transfer means, a drive track on said blocker having a driven engagement with said drive member, said drive track disposed in a direction transverse with respect to the direction of movement of said blocker whereby said blocker is shifted between said first and second positions in response to motor operation.

2. A locking mechanism as in claim 1 wherein said drive member is a drive pin and said track is a slot having track elements on opposite sides.

3. A locking mechanism as in claim 1 wherein said key means includes a pattern of magnetic coding and an extension for mechanically moving said bolt between said locked and unlocked positions, said actuating mechanism being responsive to said magnetic coding whereby to initiate energization of said motor.

4. A locking mechanism as in claim 1 wherein said blocker is a locking bar movable along its long axis radially with respect to said cylinder plug assembly between a position of engagement with said cylinder plug assembly and a position out of engagement with said cylinder plug assembly.

5. A locking mechanism as in claim 1 wherein said motor powered means comprises an electric motor, a speed reducing gear train comprising a worm drive and a gear, and a drive connection between said blocker and said gear train.

6. A locking mechanism as in claim 5 wherein said motor and said gear train rotate in one direction only.

7. A locking mechanism as in claim 1 wherein the transfer means has an axis of rotation in a position parallel to the axis of rotation of said cylinder plug.

8. A locking mechanism as in claim 1 wherein for the electric motor powered means there is a switch means mounted on the frame having mechanized actuating means, a camming means including a camway mounted on said power transfer means, said camway having a first portion in operatable engagement with said actuating means during a portion of the rotation of said power transfer means whereby to hold said switch means in closed position and a second portion in a position removed from operatable engagement with said actuating means during another portion of the rotation of said power transfer means whereby to release said switch means from closed position.

9. A locking mechanism as in claim 8 wherein said switch means comprises two electric switches and an actuating means for each switch.

10. A locking mechanism as in claim 8 wherein said switch means comprises two electric switches and an activating means for each switch, there being two camming means in parallel relationship on said power transfer means with a camway for each camming means, one of said camways having first and second portions in operatable relationship with the activating means for one of said switches, the other of said camways having first and second portions in operatable relationship with the activating means for the other of said switches.

11. A locking mechanism as in claim 8 wherein said power transfer means includes a transfer shaft and a gear rotatably mounted on said transfer shaft and in driven relationship with said electric motor powered means, and a yieldable connection between said gear and said transfer shaft, said yieldable connection having a range sufficient to enable rotation of said camway to switch open position irrespective of corresponding movement of said blocker.

12. A locking mechanism as in claim 11 wherein said yieldable connection comprises a torsion spring having one end in engagement with said gear and the other end in engagement with said transfer shaft.

13. A locking mechanism as in claim 11 wherein said yieldable connection comprises a torsion spring having one end in engagement with both said gear and said transfer shaft in one direction and having the other end in engagement with both said gear and said transfer shaft in the opposite direction.

14. A locking mechanism as in claim 11 wherein said motor powered means comprises a motor for rotation to positions for respectively locking and unlocking the locking bolt, and a worm drive in driven relationship with said motor, said transfer means comprising a transfer shaft and a gear rotatably mounted on said transfer shaft and in driven relationship with said worm drive, said camming means comprising a disc nonrotatably anchored to said gear, the first and second portions of said camway being located on a circumferential edge of said disc.

15. A locking mechanism as in claim 1 wherein when the blocker is in said first position the drive pin is adjacent top dead center position with respect to said drive track whereby to preclude unauthorized dislodgment of said blocker from said notch.

16. A locking mechanism as in claim 12 wherein there is a transverse extension on said gear and a transverse extension on said transfer shaft, said transverse extensions being in substantially overlying relationship and both of said extensions having an operable relationship with both ends of said torsion spring.

* * * * *